US012757969B2

(12) United States Patent
Zbinden

(10) Patent No.: US 12,757,969 B2
(45) Date of Patent: Oct. 13, 2026

(54) FOOTWEAR INTEGRATING PHALANGEAL-METATARSAL JOINT EXTENSION

(71) Applicant: Adam Zbinden, Kenmore, WA (US)

(72) Inventor: Adam Zbinden, Kenmore, WA (US)

(73) Assignee: OpticAmpere LLC, Spokane, WA (US)

( * ) Notice: Subject to any disclaimer, the term of this patent is extended or adjusted under 35 U.S.C. 154(b) by 0 days.

(21) Appl. No.: 19/432,915

(22) Filed: Dec. 24, 2025

(65) Prior Publication Data

US 2026/0191289 A1 Jul. 9, 2026

(51) Int. Cl.
*A43B 3/12* (2006.01)

(52) U.S. Cl.
CPC ..... *A43B 3/128* (2013.01)

(58) Field of Classification Search
CPC ..... A43B 3/128; A43B 3/12; A43B 3/122; A43B 3/126; A43B 7/26; A61F 5/019; A61H 2001/027
USPC ..... 36/11.5, 94
See application file for complete search history.

(56) References Cited

U.S. PATENT DOCUMENTS 4,017,987 A * 4/1977 Perez, Jr. ..... A43B 3/105 36/94
5,870,837 A * 2/1999 Poulos ..... A43B 7/26 36/94
5,946,823 A * 9/1999 Yates ..... A43B 13/40 36/94
6,116,253 A * 9/2000 Armstrong ..... A43B 7/26 36/94
6,298,580 B1 * 10/2001 Tadayon ..... A43B 7/26 36/94
6,678,971 B2 * 1/2004 Brooks ..... A43B 3/105 36/94
7,603,797 B2 * 10/2009 Chung ..... A61F 5/14 36/94
8,020,319 B1 * 9/2011 Mohaupt ..... A43B 3/122 36/51
10,894,184 B2 * 1/2021 Zbinden ..... A63B 23/10
2010/0223812 A1 * 9/2010 Batanero Bastida .. A43B 13/12 36/11.5
2012/0079738 A1 * 4/2012 Alberi ..... A43B 3/122 36/11.5
2015/0020415 A1 * 1/2015 Teitz ..... A43B 3/126 36/100
2019/0029389 A1 * 1/2019 Levy ..... A43B 3/12
2021/0030103 A1 * 2/2021 Reichard ..... A43B 3/242
2025/0134203 A1 * 5/2025 Meredith ..... A43B 7/26

FOREIGN PATENT DOCUMENTS

FR 2973655 A1 * 10/2012 ..... A43B 3/244
IT 202200007727 A1 * 10/2023 ..... A43B 3/122
WO WO-2012116382 A1 * 9/2012 ..... A43B 3/122

* cited by examiner

*Primary Examiner* — Jameson D Collier

(57) ABSTRACT

A sandal which integrates toe spacing elements, where a monolithically fabricated outsole and raised footbed feature an inner recessed channel in the forefoot region which integrates vertical ends of toe spacing elements at integrated receptacle locations using flexible straps, which also provide a lacing network for the sandal, using midfoot and heel anchoring locations integrated with the outsole.

1 Claim, 2 Drawing Sheets

FOOTWEAR INTEGRATING PHALANGEAL-METATARSAL JOINT EXTENSION

BACKGROUND OF THE INVENTION

Podiatric health is an increasingly present topic of public discourse, as a deepening awareness of the connection between the bones of the foot, and the rest of the skeleton, as well as the plethora of nerve endings residing in the feet which affect numerous physiological systems, as taught by reflexology, creates a necessity for maintaining or improving foot health as a part of holistic preventative medicine regimes.

Many underlying foot injuries and conditions are treated symptomatically with arch supports or insoles, and while this may provide a compensating effect for debilitating foot injuries or underlying imbalances initially, these orthotic implements lead to a further decrease in foot strength and health over time.

It is a fact of physiology and musculoskeletal anatomy that the legs start at the toes, and that the toes are, in musculoskeletal terms, the ground interface for the entire bipedal musculoskeletal system, and almost every muscle in the leg terminates—or originates, depending on one's point of reference—in the feet by way of the toes and forefoot.

The toes are then the gateway to overall foot health, which in turn determines and controls overall leg health, in musculoskeletal terms. Having established this anatomically-derived control hierarchy for how musculoskeletal health outcomes in the legs are determined, it becomes clear that the health of the forefoot—or the toes—is of primary importance in maintaining healthy musculoskeletal function in the rest of the leg, up to the hip and gluteal region, and even the lumbar spine.

Toe spacers are gaining popularity as an accessible and effective treatment for overall foot health conditions, as the metatarsal joint separation enabled by these devices restores blood flow and natural bone alignment as required for optimal body weight load bearing while bipedal. Existing silicone toe spacers advertise that they may be worn inside of shoes which have a sufficiently wide toe box, but it is otherwise not possible, from existing art, to integrate toe spacers with footwear, and it would be desirable if footwear integrated toe spacing functionality as part of the lacing required to secure the outsole to the foot.

SUMMARY OF THE INVENTION

It is the object of the present invention to provide a sandal which integrates toe spacers with the lacing structure of the outsole, such that the laces which secure the outsole of the sandal—or shoe—to the foot also connect with toe spacing elements such that toe spacing elements which provide metatarsal joint separation are integrated with the shoe outsole and footbed such that toe spacers may be worn while walking in a manner which prevents tripping hazards and also protects the toe spacing elements, which are manufactured from medical grade materials which are not rated for environmental durability in the manner required for shoe outsoles and ground contact. The present invention teaches an additively manufactured custom monolithic outsole and footbed which integrates with U.S. Ser. No. 10/894,184B2 "Foot Stretching Device" to provide a sandal or shoe to enable the use of toe spacers with protective footwear in an actively bipedal manner. The present invention is scaled and produced with additive manufacturing according to the custom foot pattern of a user wearing U.S. Ser. No. 10/894,184B2 "Foot Stretching Device" while barefoot, such that the outsole and footbed which integrates with the flexible rail straps of U.S. Ser. No. 10/894,184B2 for lacing purposes is custom fit to individual user foot geometry to provide sandals with integrated toe spacer functionality, which may be covered for additional environmental protection, if a natural or synthetic top cover material is integrated with the present invention, in a manner obvious to one skilled in the art field of the present invention.

DETAILED DESCRIPTION OF THE INVENTION

The present invention comprising a monolithic outsole and raised footbed which is configured to provide integrated toe spacer functionality when paired with the elements of U.S. Ser. No. 10/894,184B2 may be produced using additive manufacturing, choosing materials, such as TPU, which are of suitable durability for environmental contact while also being safe for biomedical applications involving skin contact.

It will be obvious to one skilled in the art that an insole may be glued or otherwise secured to the raised footbed 3 of the present invention, for aesthetic or tactile preferences, and a synthetic or natural top cover may be attached to the outsole 4, midfoot anchors 6, and heel anchor 7 to create a covered sandal, depending on environmental protection requirements.

Figure 1:
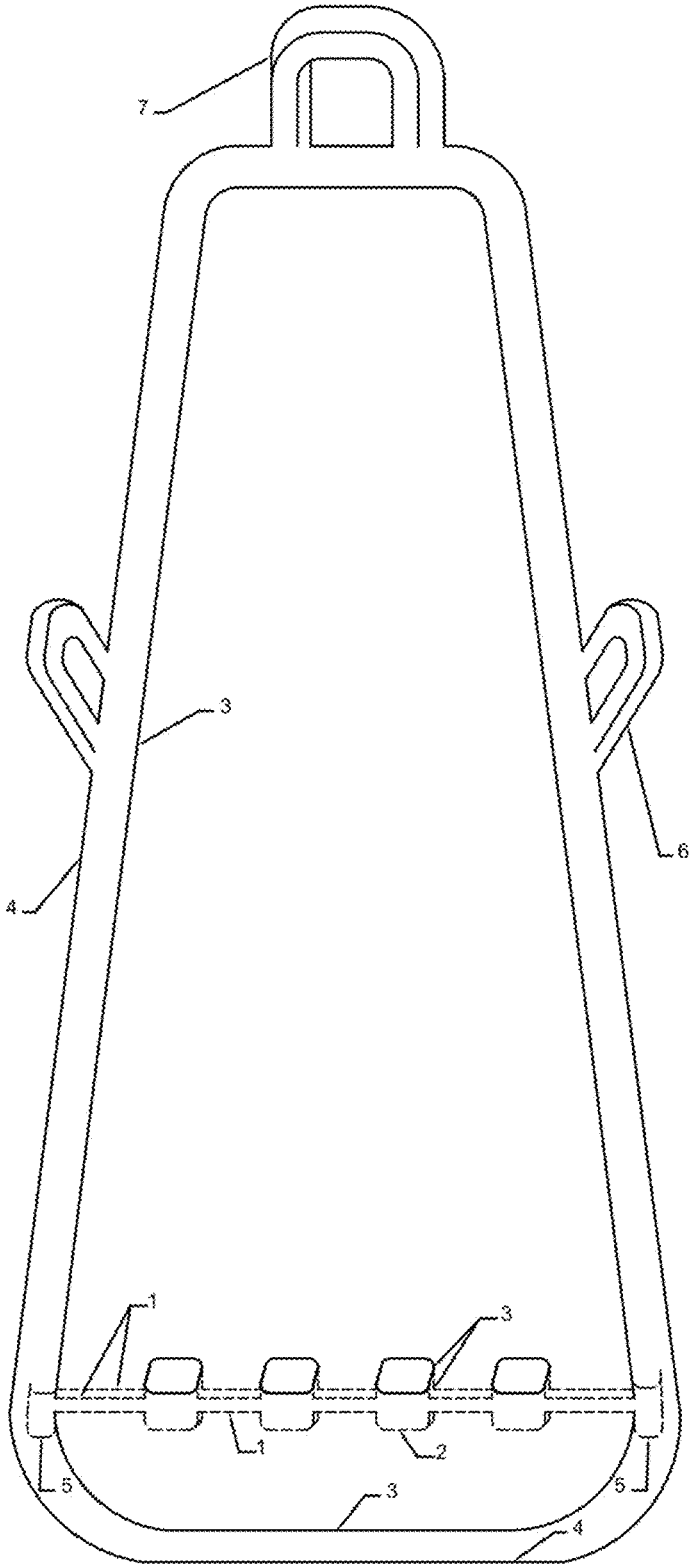
FIG. 1 depicts the monolithic outsole 4 and raised footbed 3 of the present invention, where 1 is a channel recessed within the forefoot-region of the present invention, where flexible rail straps are threaded through 1, while 2 is an integrated receptable for housing a vertical end of a columnar toe spacing element within the forefoot region of the outsole 4 and raised footbed 3 of the present invention, where 3 is the raised footbed which provides an upper boundary for the recessed inner channel 1, where the lower boundary of 1 is formed by spacing element vertical end receptable 2, while an anchored end of the flexible rail strap connects the clasp endpoint receptable 5 with the monolithic outsole 4 while also securing the flexible rail straps woven through the inner channel 1 to the raised footbed 3. Midfoot anchor points 6 and heel anchor point 7 integrated with outsole 4 provide a spatially balanced connection between the monolithic outsole 4 and footbed 3 of the present invention with a user's foot.
Figure 2:
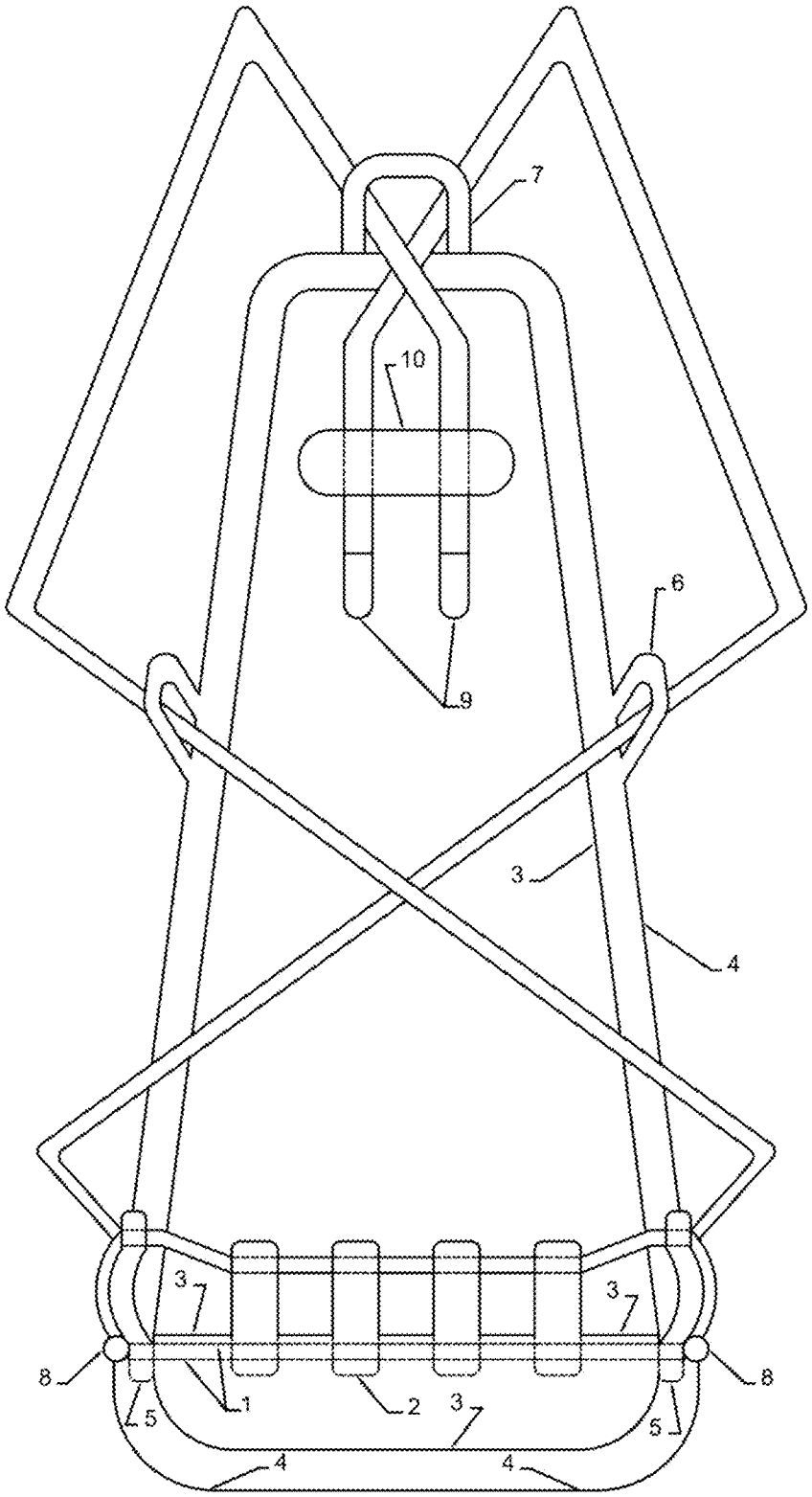
FIG. 2 depicts the integration of the present invention with toe spacing elements where the flexible rail straps also function as laces to secure the outsole 4 and footbed 3 of the present invention to a user's foot, where 8 depicts the anchored end connection of a flexible rail strap to the outsole 4 on the outer region of the clasp endpoint receptable 5, while the columnar toe spacing elements are integrated at a vertical end via integrated connection slots at the receptables 2 of the present invention, while the flexible rail straps are woven through the recessed channel 1 of the present invention, as secured between the spacing element vertical end receptable 2 and the raised footbed 3, and the travelling ends 9 of the flexible rail straps weave through midfoot anchor points 6 and heel anchor point 7 to form a lacing structure which secures the present invention to a user's foot, while the cuff which binds together the travelling ends of the flexible rail straps is shown with 10 and may be comprised of a cord lock or simple knot around the ankle of a user in the manner of a shoe tie.

The spacing of the toe spacing element vertical end receptables 2, and clasp endpoint receptacles 5, is determined from a photo or 3-D scan of a user while wearing the device of U.S. Ser. No. 10/894,184B2, such that the present invention is scaled and produced to custom-fit the foot geometry of individual users. After manufacturing the present invention for a custom foot geometry, integrating U.S. Ser. No. 10/894,184B2 with the present invention requires situating the toe spacing elements and end clasps in 2 and 5, respectively, and threading the rail straps through the recessed channel 1 of the present invention such that the connection slots and attachment points of the toe spacing elements and end clasps are secured to the monolithic outsole and raised footbed of the present invention, as shown in FIG. 2.

The lacing pattern created from weaving the travelling ends 9 of the flexible rail straps with 6 and 7 is typical, and the cuff 10 binds together the flexible rail strap travelling ends 9 after 9 is laced through 6 and 7, and said cuff may be comprised, in topological terms corresponding to the claimed preferred embodiment, of a simple knot, or a cord lock, or other obvious means for binding together two ends of flexible rail strap material which also serves as lacing which secures the monolithic outsole and raised footbed comprising a sandal with integrated toe spacing functionality to a user's foot. The webbing used for flexible rail straps may obviously be comprised of any woven material, synthetic or natural, and may be flat or circular, such as woven round cord with tensile strength sufficient for footwear duty. While nylon or polyester are the preferred synthetic materials, hemp, cotton or other natural materials, in circular or flat configuration, may be used in the claimed rail strap elements which serve as sandal laces in the present invention.

The invention claimed is:

1. A sandal configured to be used with a device, the device comprising a plurality of inter-toe spacing elements and a pair of clasps, wherein the pair of clasps are adapted to be positioned at opposing sides of a forefoot region of the sandal, the plurality of inter-toe spacing elements each comprising a respective vertical end, the device comprising a pair of flexible rail straps, the pair of clasps each comprising a respective clasp insertion point with an exterior, the device further comprising a cuff configured to surround a lower leg region of a wearer, wherein the cuff includes a plurality of attachment surfaces that bond traveling ends of the flexible rail straps; wherein the sandal comprises:

a monolithic outsole with a raised footbed, wherein the outsole is configured to integrate with the inter-toe spacing elements and the clasps of the device, wherein the raised footbed is integrated with said outsole at a plurality of locations configured to provide phalangeal contact;

a plurality of inter-phalangeal receptacles integrated with said monolithic outsole, wherein an inter-phalangeal receptacle of the plurality of inter-phalangeal receptacles is configured to receive a respective one of the vertical ends of a respective one of the inter-toe spacing elements, wherein the respective inter-phalangeal receptacle forms a respective connection slot for the respective one of the inter-toe spacing elements;

a pair of side receptacles integrated with said outsole, the pair of side receptacles disposed on opposite extents of the plurality of inter-phalangeal receptacles, wherein the pair of side receptacles are configured to receive a respective one of the clasp insertion points with a respective anchored end of a respective one of the flexible rail straps attached to the exterior of said respective clasp insertion point;

a recessed horizontal channel integrated within the outsole and positioned beneath said raised footbed, wherein said recessed horizontal channel is adapted to retain said pair of flexible rail straps, said recessed horizontal channel is integrated with a plurality of inter-toe spacing element connection slots adapted to receive said vertical ends of the plurality of inter-toe spacing elements of the device;

a pair of side strap anchors integrated with said outsole and positioned at a corresponding pair of midfoot locations of the outsole, wherein the pair of side strap anchors are configured to integrate with said traveling ends of said flexible rail straps; and, a heel strap anchor integrated with said outsole and positioned at a heel location of the outsole, wherein the heel strap anchor is configured to integrate with said traveling ends of said flexible rail straps.

* * * * *